US008608947B2

(12) United States Patent
Petri et al.

(10) Patent No.: US 8,608,947 B2
(45) Date of Patent: Dec. 17, 2013

(54) TWO-STAGE HYDROTREATING PROCESS

(75) Inventors: John A. Petri, Wauconda, IL (US); Vedula K. Murty, Willowbrook, IL (US); Peter Kokayeff, Naperville, IL (US)

(73) Assignee: UOP LLC, Des Plaines, IL (US)

( * ) Notice: Subject to any disclaimer, the term of this patent is extended or adjusted under 35 U.S.C. 154(b) by 323 days.

(21) Appl. No.: 12/894,197

(22) Filed: Sep. 30, 2010

(65) Prior Publication Data

US 2012/0080355 A1 Apr. 5, 2012

(51) Int. Cl.

| | |
|---|---|
| ***C10G 45/22*** | (2006.01) |
| ***C10G 45/02*** | (2006.01) |
| ***C10G 45/00*** | (2006.01) |

(52) U.S. Cl.

USPC ..... 208/209; 208/46; 208/57; 208/177; 208/210; 208/213

(58) Field of Classification Search

USPC ..... 208/210, 209, 213, 46, 57, 177

See application file for complete search history.

(56) References Cited

U.S. PATENT DOCUMENTS

| | | | |
|---|---|---|---|
| 5,114,562 | A | 5/1992 | Haun et al. |
| 5,720,872 | A | 2/1998 | Gupta |
| 6,261,441 | B1 | 7/2001 | Gentry et al. |
| 6,379,532 | B1 | 4/2002 | Hoehn et al. |
| 6,379,535 | B1 | 4/2002 | Hoehn |
| 6,395,950 | B1 | 5/2002 | Rice |
| 6,407,303 | B1 | 6/2002 | O'Brien |
| 6,632,350 | B2 | 10/2003 | Gupta |
| 6,835,301 | B1 | 12/2004 | Ellis |
| 6,881,326 | B2 | 4/2005 | Ackerson et al. |
| 7,005,057 | B1 | 2/2006 | Kalnes |
| 7,622,034 | B1 | 11/2009 | Thakkar |
| 2001/0042699 | A1 | 11/2001 | Cash et al. |
| 2005/0247602 | A1 | 11/2005 | Shih et al. |
| 2006/0260981 | A1 | 11/2006 | Gosling |
| 2008/0230441 | A1 | 9/2008 | Hunter |
| 2009/0095651 | A1 * | 4/2009 | Leonard et al. ..... 208/49 |
| 2010/0155294 | A1 | 6/2010 | Kokayeff |

FOREIGN PATENT DOCUMENTS

| | | | |
|---|---|---|---|
| EP | 665283 | B1 | 3/2000 |
| WO | 2009008878 | A1 | 1/2009 |

OTHER PUBLICATIONS

Pereira, C, Mild Hydrocracking Using IsoTherming Technology, 2008, 2008 Meeting of the NPRA.*

Tilton, et al., Improvement of High Cetane Number Diesel Fuels by Hydrogenation, 1948, Industrial and Engineering Chemistry, vol. 40, No. 7, pp. 1269-73.*

Perry's Chemical Engineer's Handbook, 7th Ed., 1997, McGraw-Hill, pp. 13-6; 13-9.*

Maddox,"Refining: Integrated solutions for optimised ULSD economics",Petroleum Technology Quarterly, v 8, n 5, p. 95-101, Autumn 2003.

U.S. Appl. No. 12/894,199, filed Sep. 30, 2010, Petri et al.

U.S. Appl. No. 12/894,202, filed Sep. 30, 2010, Petri et al.

* cited by examiner

*Primary Examiner* — Walter D Griffin
*Assistant Examiner* — Derek Mueller
(74) *Attorney, Agent, or Firm* — James C Paschall

(57) ABSTRACT

A process is provided to produce an ultra low sulfur diesel using a two stage hydrotreating reaction zone. The first stage hydrotreater may operate with a continuous liquid phase.

19 Claims, 1 Drawing Sheet

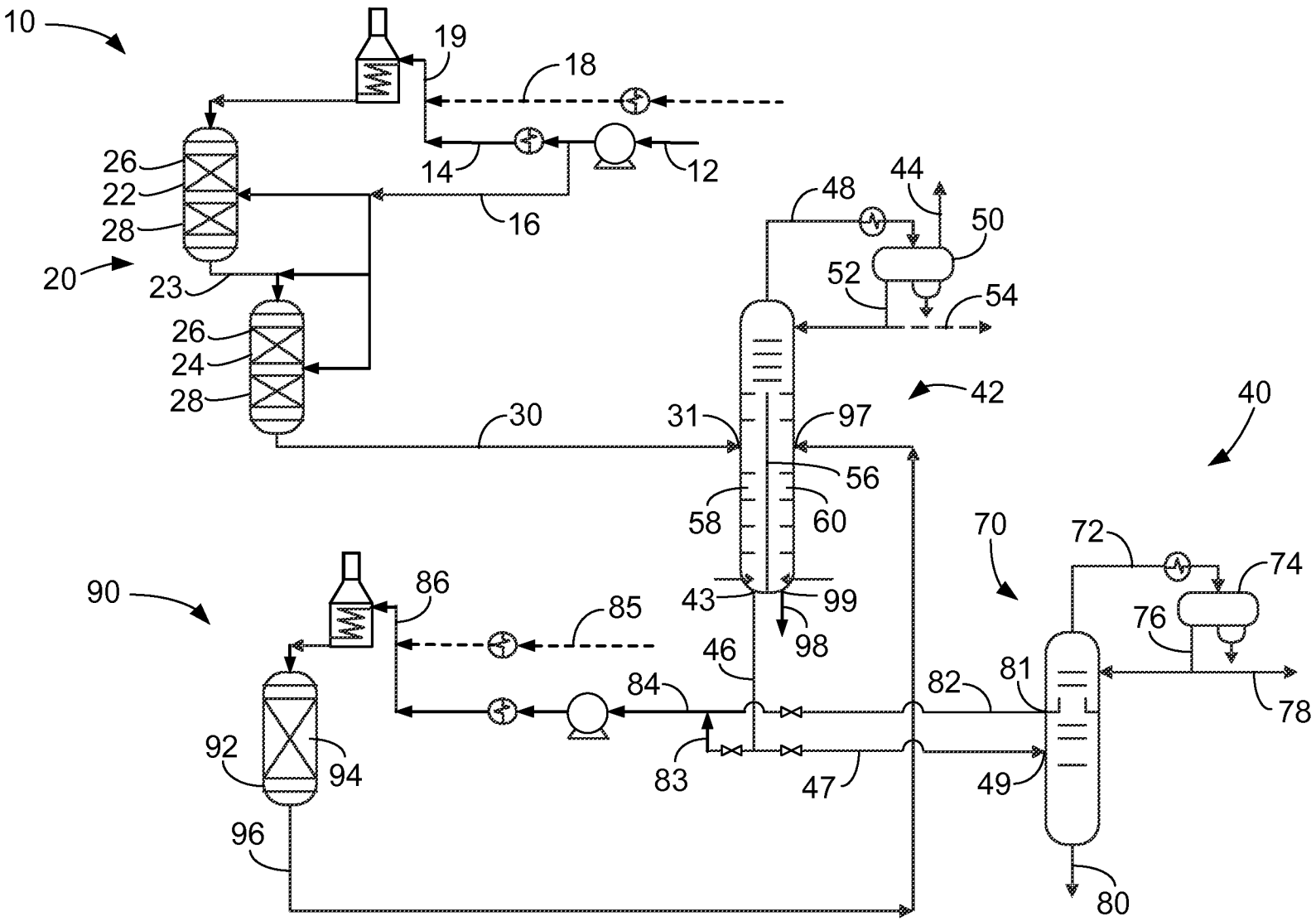
10
12
14
16
18
19
20
22
23
24
26
28
30
31
40
42
43
44
46
47
48
49
50
52
54
56
58
60
70
72
74
76
78
80
81
82
83
84
85
86
90
92
94
96
97
98
99

TWO-STAGE HYDROTREATING PROCESS

FIELD OF THE INVENTION

The invention relates to a hydrocarbon conversion process for the production of low or ultra low sulfur diesel.

BACKGROUND

It has been recognized that due to environmental concerns and newly enacted rules and regulations, saleable petroleum products must meet lower and lower limits on contaminates, such as sulfur and nitrogen. New regulations require essentially complete removal of sulfur from liquid hydrocarbons that are used in transportation fuels, such as gasoline and diesel. For example, ultra low sulfur diesel (ULSD) requirements are typically less than about 10 wppm sulfur.

Hydroprocessing is a process that contacts a selected feedstock and hydrogen-containing gas with suitable catalyst(s) in a reaction vessel under conditions of elevated temperature and pressure. The hydrogen is conventionally a separate phase in a three-phase system (gas/liquid/solid catalyst). Such hydroprocessing is commonly undertaken in a trickle-bed reactor where the continuous phase is gaseous and not liquid. The continuous gas phase is far in excess of stoichiometry requiring gas recovery, clean-up, compression and recycle back to the hydroprocessing reaction vessel.

Continuous liquid phase hydroprocessing with a liquid hydrocarbon stream and solid catalyst has been proposed to convert certain hydrocarbon streams into more valuable hydrocarbon streams with less hydrogen requirements. Continuous liquid phase hydroprocessing can operate without a gas recycle stream because the hydrogen requirements can be just over stoichiometric.

Hydrotreating is a type of hydroprocessing primarily active for the removal of heteroatoms, such as sulfur and nitrogen, and saturation of compounds in the hydrocarbon feedstock. Hydrotreating can typically increase the cetane number of a hydrocarbonaceous feed and prepare the feed for further hydroprocessing.

Fractionation columns are necessary to separate hydroprocessed effluents into separate products as distinguished by boiling point ranges. Naphtha, diesel and heavier products are typically recovered from hydroprocessed effluents.

There is a continuing need, therefore, for improved and cost effective methods to produce hydrocarbon streams that meet increasingly stringent product requirements. In particular, there is a need to provide ULSD in a cost effective and efficient manner without overtreating the heavier portions of the product streams.

SUMMARY

In a process embodiment, the present invention comprises a process to produce low sulfur diesel comprising hydrotreating a hydrocarbonaceous feedstock, which in an aspect is in the diesel boiling range, with hydrogen over a hydrotreating catalyst in a first hydrotreating reaction zone. The first hydrotreating reaction zone operates with a continuous liquid-phase at conditions effective to produce a first hydrotreated effluent having a lower sulfur concentration and an improved cetane number than that of the hydrocarbonaceous feedstock. The first hydrotreated effluent is fractionated in a fractionation zone to provide a gas stream and a feed diesel stream. A feed diesel stream is hydrotreated with hydrogen in a second hydrotreating reaction zone over a hydrotreating catalyst at conditions effective to produce ultra-low sulfur diesel. In an embodiment, the second hydrotreating reaction zone operates with a continuous liquid-phase. In another embodiment, fractionation also produces a naphtha stream.

Other embodiments encompass further details of the process, such as preferred feedstocks, preferred hydrotreating catalysts, preferred hydroprocessing catalysts, and preferred operating conditions to provide but a few examples. Such other embodiments and details are hereinafter disclosed in the following discussion of various aspects of the process.

DEFINITIONS

The term "communication" means that material flow is operatively permitted between enumerated components.

The term "downstream communication" means that at least a portion of material flowing to the subject in downstream communication may operatively flow from the object with which it communicates.

The term "upstream communication" means that at least a portion of the material flowing from the subject in upstream communication may operatively flow to the object with which it communicates.

The term "column" means a distillation column or columns for separating one or more components of different volatilities which may have a reboiler on its bottom and a condenser on its overhead. Unless otherwise indicated, each column includes a condenser on an overhead of the column to condense and reflux a portion of an overhead stream back to the top of the column and a reboiler at a bottom of the column to vaporize and send a portion of a bottoms stream back to the bottom of the column. Feeds to the columns may be preheated. The top pressure is the absolute pressure of the overhead vapor at the outlet of the column. The bottom temperature is the liquid bottom outlet temperature.

DETAILED DESCRIPTION

Diesel produced from hydrotreating a vacuum gas oil (VGO) in conventional trickle bed hydroprocessing and particularly from a continuous liquid phase hydrotreating falls short of producing ULSD for sustained period. The typical sulfur content may be between 50 and 700 wppm in the diesel fraction produced from hydrotreating VGO or heavier feed. We have determined that diesel produced from hydrotreating a diesel boiling range feed in a hydrotreating reaction zone operating with a continuous liquid phase and in a conventional hydrotreating temperature range falls short of providing ULSD. Use of higher hydrotreating temperature conditions would uneconomically curtail catalyst life. Consequently, we have found the diesel hydrotreated with a continuous liquid phase must be further hydrotreated in a second stage to reduce the sulfur content to ULSD specifications. We have found that the second stage hydrotreating even with a continuous liquid phase is able to produce ULSD.

The proposed process and apparatus fractionates the effluent from a first hydrotreating zone to remove hydrogen sulfide and ammonia generated by hydroprocessing organic sulfur and nitrogen. The cleaned up diesel stream may be further fractionated or sent directly to a second hydrotreating zone to produce ULSD.

In one aspect, the processes and apparatuses described herein are particularly useful for hydroprocessing a hydrocarbonaceous feedstock containing diesel or VGO boiling range hydrocarbons. Illustrative hydrocarbon feedstocks include hydrocarbonaceous streams having components boiling above about 288° C. (550° F.), such as atmospheric gas oils, vacuum gas oils, deasphalted, vacuum, and atmospheric residua, hydrotreated or mildly hydrocracked residual oils, coker distillates, straight run distillates, solvent-deasphalted oils, pyrolysis-derived oils, high boiling synthetic oils, cycle oils, cat cracker distillates, and the like. These hydrocarbonaceous feed stocks may contain from about 0.1 to about 4 percent sulfur.

A preferred hydrocarbonaceous feedstock is a diesel stream or other hydrocarbon fraction having at least about 50 percent by weight, and usually at least about 75 percent by weight, of its components boiling at a temperature above about 149° C. (300° F.). A typical diesel stream normally has a boiling point range between about 138° C. (280° F.) and about 382° C. (720° F.).

Another suitable hydrocarbonaceous feedstock is a VGO or other hydrocarbon fraction having at least about 50 percent by weight, and usually at least about 75 percent by weight, of its components boiling at a temperature above about 371° C. (700° F.). A typical vacuum gas oil normally has a boiling point range between about 315° C. (600° F.) and about 565° C. (1050° F.).

Turning to the FIGURE, an exemplary integrated hydrocarbon processing unit to provide ULSD will be described in more detail. It will be appreciated by one skilled in the art that various features of the above described process, such as pumps, instrumentation, heat-exchange and recovery units, condensers, compressors, flash drums, feed tanks, and other ancillary or miscellaneous process equipment that are traditionally used in commercial embodiments of hydrocarbon conversion processes have not been described or illustrated. It will be understood that such accompanying equipment may be utilized in commercial embodiments of the flow schemes as described herein. Such ancillary or miscellaneous process equipment can be obtained and designed by one skilled in the art without undue experimentation.

The FIGURE shows a process and apparatus 10 for producing low sulfur diesel. A hydrocarbonaceous feedstock is introduced in line 12 and may be split between an initial stream 14 and a quench stream 16. The initial stream is preheated and combined with a hydrogen gas stream 18. The hydrogen gas stream may be provided from a make-up gas compressor (not shown). In an aspect, hydrogen in line 18 is only provided via a make-up gas compressor supplied from a general refinery hydrogen supply. The hydrogen gas stream from line 18 is admixed with the hydrocarbonaceous feedstock line 12 to provide an admixture of the hydrocarbonaceous feedstock and hydrogen in line 19.

The combined stream 19 is heated in a fired heater and fed to a first hydroprocessing reaction zone 20 or stage. The first hydroprocessing reaction zone 20 may have more than one hydroprocessing reactor 22. The first hydroprocessing reaction zone 20 shown in the FIGURE has a first hydroprocessing reactor 22 and a second hydroprocessing reactor 24. More hydroprocessing reactors are contemplated. Each of the hydroprocessing reactors 22, 24 may have just one bed of hydroprocessing catalyst 26 or have multiple hydroprocessing catalyst beds 26, 28. The quench stream 16 may bypass feed heaters and be divided up and fed to the effluent from a hydroprocessing catalyst bed or hydroprocessing reactor to cool the hot hydroprocessed effluent. A first hydroprocessed effluent exits the first hydroprocessing reaction zone 20 in line 30.

One or both of the hydroprocessing reactors 22, 24 in the hydroprocessing reaction zone 20 may be operated in a continuous liquid phase. Continuous liquid phase hydroprocessing involves introducing a liquid phase hydrocarbonaceous feedstock and hydrogen into a hydroprocessing reactor. The hydrogen should be present in a sufficiently low concentration to maintain a continuous liquid phase in the hydroprocessing reactor but high enough concentration to provide sufficient hydrogen for hydroprocessing of the hydrocarbonaceous feed. In other words, a continuous plenum of hydrocarbon liquid should extend from a feed inlet to an effluent outlet of the reactor 22, 24. Hydrogen gas may be present outside of the liquid plenum or inside of the liquid plenum in the forms of slugs or bubbles. At the very least, the volume of the liquid in the reactor will be greater than the volume of the gas in the reactor.

During the hydroprocessing reactions occurring in the hydroprocessing reactor 22, 24, hydrogen is necessarily consumed. Hydrogen may be provided to the reactor at a first feed inlet in excess or additionally replaced by one or more hydrogen inlet points located downstream of the first feed inlet (not shown). The flow rate of hydrogen added at these downstream locations is controlled to ensure that the reactor operates in a continuous liquid phase. The maximum flow rate of hydrogen that may be added to the reactor 22, 24 is less than the flow rate which would cause a transition from a continuous liquid phase to a continuous vapor phase.

In some aspects, the hydrocarbonaceous feedstock does not contain recycled product from a hydroprocessing reactor or other hydrocarbon diluent. In other aspects, a recycle stream or diluent (both not shown) may be incorporated into the fresh hydrocarbonaceous feedstock prior to hydroprocessing to feed additional volume to the reactor to provide added hydrogen-carrying capacity to the hydrocarbonaceous feedstock or to provide additional mass to reduce the temperature rise in catalyst bed 26, 28. In such aspects, any recycled product or diluent typically is introduced into the feedstock in line 14 before a hydrogen stream in line 18 is mixed with the feedstock. Typically, such recycled product may be previously stripped of a vaporous hydrogen sulfide, nitrogen or nitrogen containing compositions, and any other vapor phase materials.

In one aspect, the fresh hydrocarbonaceous feed in line 14 is provided and mixed with a hydrogen flow in line 18 from a make-up gas compressor or other similar hydrogen source. The hydrogen flow is mixed into the fresh hydrocarbonaceous feed for the hydroprocessing reaction zone 20 and is provided at a rate at least sufficient to satisfy the hydrogen requirement of the first reactor 22 and the second reactor 24 if present. In some instances, the flow rate of added hydrogen will include an amount in excess of the predicted hydrogen requirements of the hydroprocessing reaction zone 20 as reserve in event the hydrogen consumption exceeds the expected amount at a particular bed 26, 28 or reactor 22, 24.

In other aspects, hydrogen is added to the fresh feed stream to provide sufficient hydrogen to exceed the saturation point of the hydrocarbonaceous liquid so that a small vapor phase is present throughout the substantially liquid phase. Thus, there is, in some aspects, sufficient additional hydrogen in the small vapor phase to provide additional dissolved hydrogen to the continuous liquid hydrocarbon phase as the reaction consumes hydrogen. For example, the amount of added hydrogen may be about 10 to 20 wt-% greater than the expected collective hydrogen requirements of each hydroprocessing catalyst bed 26, 28. In yet other aspects, it is expected that the amount of hydrogen may be up to about 100 percent of saturation to about 1000 percent of the saturated liquid phase hydrocarbon. Excess hydrogen is carried in the effluent from the first hydroprocessing reactor 22 in either solution, a gaseous phase, or both in a gaseous phase and solution in the liquid effluent stream 23 carrying effluent from the first hydroprocessing reactor 22 to the second hydroprocessing reactor 24. In this aspect, no other hydrogen is added to the hydroprocessing reaction zone 20. In other aspects, supplemental hydrogen may be added to the hydroprocessing reactors 22, 24. It will be appreciated, however, that the amount of hydrogen added to the hydroprocessing reaction zone 20 can vary depending on the feed composition, operating conditions, desired output, and other factors. In an aspect, the liquid hydrocarbonaceous feed may include about 67 to about 135 $Nm^3$ hydrogen per $m^3$ oil (400 to 800 scf/bbl). In this aspect, a continuous gas phase may exist along with the continuous liquid phase extending from feed inlet to product outlet or each reactor 22, 24. As such, about 4 to about 25 $Nm^3$ hydrogen per $m^3$ oil (25 to 150 scf/bbl) may exit the outlet from a catalyst bed 26, 28 or each outlet of a reactor 22, 24.

The hydroprocessing that takes place in the first hydroprocessing reaction zone is hydrotreating such as hydrodesulfurization or saturation. Consequently, the first hydroprocessing reaction zone 20 is a hydrotreating reaction zone 20. Additionally, one or all of the hydroprocessing reactors 22, 24 are hydrotreating reactors 22, 24 with one bed 26 or more beds 26, 28 of hydrotreating catalyst. Moreover, in this aspect, the first hydroprocessed effluent in line 30 is a first hydrotreated effluent.

In hydrotreating, hydrogen gas is contacted with hydrocarbonaceous feedstock in the presence of suitable catalysts which are primarily active for the removal of heteroatoms, such as sulfur and nitrogen from the hydrocarbon feedstock. In hydrotreating, unsaturated hydrocarbons are saturated. Suitable hydrotreating catalysts for use in the present invention are any known conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable hydrotreating catalysts include zeolitic catalysts, as well as noble metal catalysts where the noble metal is selected from palladium and platinum. It is within the scope of the present invention that more than one type of hydrotreating catalyst be used in the same reaction vessel. The Group VIII metal is typically present in an amount ranging from about 2 to about 20 wt-%, preferably from about 4 to about 12 wt-%. The Group VI metal will typically be present in an amount ranging from about 1 to about 25 wt-%, preferably from about 2 to about 25 wt-%.

Suitable hydrotreating reaction conditions include a temperature from about 204° C. (400° F.) to about 482° C. (900° F.), preferably no more than 388° C. (730° F.), a pressure from about 3.5 MPa (500 psig) to about 17.3 MPa (2500 psig), preferably no more than 10,342 kPa (1500 psig), a liquid hourly space velocity of the fresh hydrocarbonaceous feedstock from about 0.1 $hr^{-1}$ to about 10 $hr^{-1}$ with a hydrotreating catalyst or a combination of hydrotreating catalysts. In an aspect, hydrotreated effluent having a lower sulfur concentration and an improved cetane number than that of the hydrocarbonaceous feedstock exits the hydrotreating reaction zone 20 in line 30 and enters a fractionation zone 40.

We have found that the first stage of hydrotreating with a continuous liquid phase is not able to desulfurize diesel boiling range hydrocarbons down to ULSD. Not being bound to any particular theory, we believe the hydrotreating byproducts, hydrogen sulfide and ammonia, which stay in the liquid phase if not removed, impede the necessary degree of desulfurization. Hence, we have determined that a second stage of hydrotreating is necessary to desulfurize diesel that has been hydrotreated with a continuous liquid phase in a first stage down into the ULSD range. In an aspect, a second stage of hydrotreating is conducted after separation of gases from liquid products of the first stage.

Although not shown, the first hydroprocessed effluent in line 30 may be flashed to separate gas from liquid and a relief valve installed on the gas line to relieve the hydroprocessing reaction zone 20 in the event of over pressurization. The gas and liquid stream may be recombined downstream of the relieve valve.

The fractionation zone 40 comprises a fractionation column 42. The fractionating column 42 fractionates the first hydroprocessed effluent entering through inlet 31 to provide a light gas stream in the off-gas line 44 and a diesel stream in a bottoms stream 46. In an embodiment, an overhead line 48 removes vapor from a top of the fractionating column 42. The vapor from line 48 is condensed and deposited in a receiver 50. The off-gas line 44 removes light gas from a top of the receiver 50, and unstabilized naphtha from a bottom of the receiver in line 52. An aqueous phase may be removed from a boot in the receiver 50. At least a portion of the unstabilized naphtha may be refluxed to the fractionation column 42, while unstabilized naphtha may be recovered in line 54 for further processing. The top pressure in the fractionation column 42 ranges between about 450 and about 1150 kPa and the bottom temperature in the dividing wall fractionation column 42 ranges between about 204° and about 260° C. if the feed in line 12 is predominantly a diesel boiling range feed and between about 232° and about 315° C. if the feed in line 12 is predominantly a VGO boiling range feed. Other bottom temperatures may be suitable for different feeds in line 12.

In an aspect, fractionation column 42 may be a dividing wall fractionation column 42. A dividing wall 56 may divide the dividing wall column 42 into separate compartments on a first side 58 and a second side 60. In this aspect, the first hydroprocessed effluent is fed to the first side 58 of the dividing wall fractionation column 42 through inlet 31, so the first side 58 is in downstream communication with the first hydroprocessing reaction zone 20. The diesel stream is recovered at a bottom of the first side 58 of the dividing wall fractionation column 42. In an aspect, the dividing wall 56 extends to the bottom of the dividing wall fractionation column 42 and is sealed to a bottom and inner walls of the dividing wall column to prevent fluid communication between compartments on the first side 58 and the second side 60 at any location below a top of the dividing wall 56. The first hydroprocessed effluent is fed to the first side 58 at inlet 31 located below a top of the dividing wall 56. The dividing wall column may be a dividing wall stripper 42 which utilizes inert gas injection into the bottom of the first side to strip gaseous components from the downflowing liquid instead of utilizing a reboiler. The inert gas may be hydrogen or steam, but steam is preferred. A diesel stream may exit the first side 58 through diesel outlet 43, which is located below the inlet 31 to the first side 58 at a bottom of the fractionation column 42. The bottom temperature in the first side 58 of the dividing wall fractionation column 42 ranges between about 204° and about 260° C. if the feed in line 12 is predominantly a diesel boiling range feed and between about 232° and about 315° C. if the feed in line 12 is predominantly a VGO boiling range feed.

We have found that the diesel stream 46 which comprises diesel and may comprise heavier components may not qualify as an ULSD stream because it may comprise as much as 50 to 700 wppm sulfur. We have found this to be the case when the first hydrotreating reaction zone 20 operates with a continuous liquid phase. Therefore, to make ULSD, the diesel stream must be further hydrotreated. In some cases, the diesel stream in line 46 may be further hydrotreated directly in which case, line 46 carries a feed diesel stream. In an aspect, particularly when the feed 12 is heavier feed such as VGO, the fractionation zone 40 includes a fractionator column 70 and the diesel stream in line 46 may be fed to the fractionator column 70 via line 47, so the fractionator column 70 is in downstream communication with a bottom of the first side 58.

The fractionator column 70 fractionates the diesel stream into a vapor line 72 which may be condensed and deposited in a receiver 74 to yield a naphtha stream 76. A portion of the naphtha stream may be refluxed to the fractionator column 70 and the other portion recovered as product in line 78. Hydrotreated heavy hydrocarbon such as VGO may be recovered from a bottom of the fractionator column in line 80 which may be an excellent feedstock to an FCC unit or a hydrocracking unit. A fractionated diesel stream in line 82 may be recovered as a side cut at outlet 81 from the fractionation column 70. In an aspect, the outlet 81 for the side cut is taken at a location above where the diesel stream in line 46 is fed to the fractionator column 70 via line 47 at inlet 49 from the fractionation column 42. In another aspect, the fractionated diesel stream in line 82 is collected as a liquid from a liquid collection device on a tray in the fractionator column 70. The top pressure in the fractionator column 70 ranges between about 110 and about 200 kPa absolute and the bottom temperature in the fractionator column 70 ranges between about 316 and about 371° C.

The diesel stream in either line 46 or 82 is fed to a second hydroprocessing reaction zone or stage 90 in feed diesel line 84. In an embodiment, the second hydroprocessing reaction zone is in downstream communication with the first side 58 of the dividing wall fractionation column 42 and the first hydroprocessing reaction zone 20. If the diesel stream in line 46 is the feed diesel stream, a control valve on line 83 is open and control valves on lines 47 and 82 are closed. If the fractionated diesel stream in line 82 is the feed diesel stream, the control valve on line 83 is closed and the control valves on lines 82 and 47 are open. It is contemplated that some intermediate variation between these two conditions may be used. The feed diesel stream carried in line 84 is at least a portion of the diesel stream in line 46 from a bottom of the fractionation column 42 which is fed directly to the second hydroprocessing reaction zone 90 or a cut produced from the fractionation column 70 in line 82. In the former aspect, the second hydroprocessing reaction zone 90 is in downstream communication with the fractionator column 70 through the side outlet 81. Moreover, the fractionator column 70 is in upstream communication with the second hydroprocessing reaction zone 90.

The feed diesel stream in line 84 is hydroprocessed with hydrogen in a second hydroprocessing reaction zone 90 with hydroprocessing catalyst to produce a second hydroprocessed effluent. The feed diesel stream in line 84 is preheated and combined with a hydrogen gas stream in line 85. The hydrogen gas stream may be provided from a make-up gas compressor (not shown). In an aspect, hydrogen in line 85 is only provided via a make-up gas compressor supplied from a general refinery hydrogen supply. The hydrogen gas stream from line 85 is admixed with the feed diesel stream in line 84 to provide an admixture of the feed diesel stream and hydrogen in line 86.

The combined stream 86 is heated in a fired heater and fed to the second hydroprocessing reaction zone 90. The second hydroprocessing reaction zone 90 may have more than one hydroprocessing reactor 92. The second hydroprocessing reaction zone 90 shown in the FIGURE has only one hydroprocessing reactor 92. More hydroprocessing reactors are contemplated. The hydroprocessing reactors 92 may have just one bed of hydroprocessing catalyst 94 or have multiple hydroprocessing catalyst beds. A second hydroprocessed effluent exits the second hydroprocessing reaction zone 90 in line 96.

The hydroprocessing reactor 92 in the second hydroprocessing reaction zone 90 may be operated in a continuous liquid phase as explained with respect to the first hydroprocessing reaction zone 20. Hydrogen may be added to the hydroprocessing reactor 92 as explained with respect to the first hydroprocessing reaction zone 20. Product recycle or diluent may be supplied to the hydroprocessing reactor 92 as explained with respect to the first hydroprocessing reaction zone 20.

The hydroprocessing that takes place in the first hydroprocessing reaction zone is hydrotreating as explained with respect to the first hydrotreating reaction zone 20. In this preferred aspect, the second hydroprocessing reaction zone 90 is a second hydrotreating reaction zone 90. In this aspect, one or all of the hydroprocessing reactors 92 are hydrotreating reactors 92 with one bed 94 or more beds of hydrotreating catalyst. Moreover, in this aspect, the second hydroprocessed effluent in line 96 is a second hydrotreated effluent in line 96.

Essentially all of the ammonia and hydrogen sulfide are removed as off-gas from the fractionation column 42, so the second hydrotreating catalyst in the second hydrotreating zone 90 is much more effective in converting feed diesel into ULSD. With nitrogen and sulfur species absent, the hydrotreating catalyst in the hydrotreating reactor 92 is effective in removing remaining sulfur species to produce ULSD. The second hydrotreated effluent comprising ULSD exits the second hydroprocessing reaction zone 90 in line 96.

Although not shown, the second hydroprocessed effluent in line 96 may be flashed to separate gas from liquid and a relief valve installed on the gas line to relieve the hydroprocessing reaction zone 90 in the event of overpressurization. The gas and liquid stream may be recombined downstream of the relieve valve.

The second hydrotreated effluent in line 96 may be fed to the fractionation column 42 to fractionate the second hydrotreated effluent into off-gas and unstabilized naphtha and produce a ULSD stream in line 98 exiting a bottom of the second side 60 through an outlet 99 which is below the inlet 97.

In an aspect, the fractionation column 42 is a dividing wall column and the second hydroprocessed effluent is fed to the second side 60 of the dividing wall 56 in the dividing wall fractionation column 42 through inlet 97, so the second side 60 of the dividing wall fractionation column is in downstream communication with the second hydroprocessing reaction zone 90. The inlet 97 to the second side 60 is at an elevation lower than a top of said dividing wall 56. In an aspect, the dividing wall 56 extends to the bottom of the dividing wall fractionation column 42 and is sealed to the bottom and sides of the dividing wall column to prevent communication between the first side 58 and the second side 60 at any location below a top of the dividing wall 56. The second hydroprocessed effluent is fed to the second side 60 below a top of the dividing wall 56. The dividing wall column may be a dividing wall stripper 42 which utilizes inert gas injection into the bottom of the first side to strip gaseous components from the downflowing liquid instead of utilizing a reboiler. The inert gas may be hydrogen or steam, but steam is preferred. The bottom temperature in the second side 60 of the dividing wall fractionation column 42 ranges between about 204 and about 260° C.

The ULSD stream is recovered at a bottom of the second side 60 of the dividing wall fractionation column 42 from outlet 99.

EXAMPLE

To show the difficulty of desulfurizing diesel into ULSD, a straight run diesel boiling range feedstock having the properties in Table 1 was subjected to hydrotreating with a continuous liquid phase.

TABLE 1

| | |
|---|---|
| API | 28.73 |
| Sulfur, wt-% | 1.37 |
| Nitrogen, wppm | 150 |
| Monoaromatics, wt-% | 21.7 |
| Diaromatics, wt-% | 12.6 |
| Polyaromatics, wt-% | 1.7 |
| Bromine Number | 6 |
| ASTM Distillation Method D-86, ° F. (° C.) | |
| IBP | 510 |
| 5% | 550 |
| 10% | 561 |
| 30% | 580 |
| 50% | 593 |
| 70% | 607 |
| 90% | 630 |
| 95% | 643 |
| EP | 659 |

The diesel feed was hydrotreated over a nickel-molybdenum catalyst having an amorphous alumina trilobe base. Conditions included a continuous liquid phase with a recycle rate of 5 to 1 to ensure sufficient hydrogen was present in solution. Other process conditions as well as results are presented in Table 2.

TABLE 2

| | | |
|---|---|---|
| LHSV based on fresh feed, $hr^{-1}$ | 2.0 | 2.0 |
| Pressure, psig (kPa) | 600 (4,137) | 1200 (8,274) |
| Temperature, ° F. °(C.) | 625 (329) | 625 (329) |
| Sulfur, wppm | 3150 | 2100 |
| Nitrogen, wppm | 70 | 20 |

It was projected based on the degree of desulfurization at these conditions that desulfurization to produce ULSD could not be achievable in a temperature range of 700° to 720° F. (371° to 382° C.) with a continuous liquid phase. If desulfurization were achievable with a continuous liquid phase at greater temperatures, catalyst life would be so severely curtailed, that operation under these conditions would not be economical.

A product from hydrotreated VGO boiling in the diesel range had the properties presented in Table 3. This diesel feed was selected to simulate diesel that had been subjected to hydrotreating and separation to remove hydrotreating products such as hydrogen sulfide and ammonia which can impede further hydrodesulfurization.

TABLE 3

| | | |
|---|---|---|
| API | 28.59 | |
| Sulfur, wppm | 554 | |
| Nitrogen, wppm | 246 | |
| Monoaromatics, wt-% | 42.3 | |
| Diaromatics, wt-% | 7.5 | |
| Polyaromatics, wt-% | 1.1 | |
| Bromine number | 6 | |
| ASTM Distillation Method, ° F. (° C.) | D-2287 | D-86 |
| IBP | 343 (173) | 482 (250) |
| 5% | 416 (213) | |
| 10% | 450 (232) | 490 (254) |
| 30% | 520 (271) | 508 (264) |
| 50% | 567 (297) | 553 (289) |
| 70% | 608 (320) | 583 (306) |
| 90% | 663 (351) | 627 (331) |
| 95% | 686 (363) | |
| EP | 755 (402) | 635 (335) |

The feed of Table 3 was hydrotreated in a continuous liquid phase to produce ULSD. Diesel produced from hydrotreating VGO, although apparently relatively low in sulfur, is very difficult to hydrotreat to low sulfur levels because remaining sulfur species are resistant to conversion. The hydrotreating catalyst used was a nickel-molybdenum on an amorphous alumina trilobe base. Process conditions as well as results are presented in Table 4.

TABLE 4

| | |
|---|---|
| LHSV based on fresh feed, $hr^{-1}$ | 1.02 |
| Pressure, psig (kPa) | 804 (5,543) |
| Temperature, ° F. (° C.) | 700 (371) |
| Hydrogen Addition, SCF/B ($Nm^3/m^3$) | 384 (65) |
| Hydrogen Consumption, SCF/B ($Nm^3/m^3$) | 242 (41) |
| Sulfur, wppm | 4 |
| Nitrogen, wppm | 4 |

Despite the refractory nature of the feedstock and the very low rate of hydrogen addition, hydrotreating in a continuous liquid phase was able to convert diesel feedstock into ULSD under higher temperature conditions. We believe that a hydrotreating this feed in a continuous gas phase, conventional trickle bed operation would be able to achieve ULSD under less severe conditions, as well.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process to produce low sulfur diesel comprising:

hydrotreating a hydrocarbonaceous feedstock in the diesel boiling range with hydrogen in a first hydrotreating reaction zone operating with a continuous liquid-phase over a hydrotreating catalyst at conditions including a temperature of no more than 730° F. effective to produce a first hydrotreated effluent having a lower sulfur concentration and an improved cetane number than that of the hydrocarbonaceous feedstock;

fractionating said first hydrotreated effluent in a fractionation zone to provide a gas stream and a feed diesel stream; and hydrotreating said feed diesel stream with hydrogen in a second hydrotreating reaction zone over a hydrotreating catalyst at conditions effective to produce ultra-low sulfur diesel.

2. The process of claim 1, wherein the second hydrotreating reaction zone operates with a continuous liquid-phase.

3. The process of claim 2, wherein make-up hydrogen is fed to the first hydrotreating reaction zone without recycle from a hydroprocessing reaction zone.

4. The process of claim 1, further comprising fractionating a second hydrotreated effluent from the second hydrotreating reaction zone in the fractionation zone to provide ultra-low sulfur diesel.

5. The process of claim 4, wherein the fractionation zone includes a dividing wall column and said first hydrotreated effluent is fed to a first side of a dividing wall in said dividing wall column and said second hydrotreated effluent is fed to a second side of said dividing wall.

6. The process of claim 5, further comprising recovering a feed diesel stream from said first side of said dividing wall and recovering ultra-low sulfur diesel from said second side of said dividing wall.

7. The process of claim 6, wherein gas is fed to the bottom of said dividing wall column to strip at least one of said first hydrotreated effluent and said second hydrotreated effluent.

8. The process of claim 1, wherein said fractionation zone also produces a naphtha stream.

9. A process to produce low sulfur diesel comprising:

hydrotreating a hydrocarbonaceous feedstock that does not contain recycled product from a hydroprocessing reactor or other hydrocarbon diluent with hydrogen in a first hydrotreating reaction zone operating with a continuous liquid-phase over a hydrotreating catalyst at conditions effective to produce a first hydrotreated effluent having a lower sulfur concentration and an improved cetane number than that of the hydrocarbonaceous feedstock;

fractionating said first hydrotreated effluent in a fractionation zone to provide a gas stream and a feed diesel stream; and hydrotreating said feed diesel stream with hydrogen in a second hydrotreating reaction zone operating with a continuous liquid-phase over a hydrotreating catalyst at conditions effective to produce ultra-low sulfur diesel.

10. The process of claim 9, wherein make-up hydrogen is fed to the first hydrotreating reaction zone without recycle from a hydroprocessing reaction zone.

11. The process of claim 9, further comprising fractionating a second hydrotreated effluent from the second hydrotreating reaction zone in the fractionation zone to provide ultra-low sulfur diesel.

12. The process of claim 11, wherein the fractionation zone includes a dividing wall column and said first hydrotreated effluent is fed to a first side of a dividing wall in said dividing wall column and said second hydrotreated effluent is fed to a second side of said dividing wall.

13. The process of claim 12, further comprising recovering said feed diesel stream from said first side of said dividing wall and recovering ultra-low sulfur diesel from said second side of said dividing wall.

14. The process of claim 13, wherein gas is fed to the bottom of said dividing wall column to strip at least one of said first hydrotreated effluent and said second hydrotreated effluent.

15. The process of claim 14, wherein said fractionation zone also produces a naphtha stream.

16. A process to produce low sulfur diesel comprising:

hydrotreating a hydrocarbonaceous feedstock that does not contain recycled product from a hydroprocessing reactor or other hydrocarbon diluent with hydrogen in a first hydrotreating reaction zone operating with a continuous liquid-phase over a hydrotreating catalyst at conditions effective to produce a first hydrotreated effluent having a lower sulfur concentration and an improved cetane number than that of the hydrocarbonaceous feedstock;

fractionating said first hydrotreated effluent in a fractionation zone to provide a gas stream, a naphtha stream and a feed diesel stream; and hydrotreating said feed diesel stream with hydrogen in a second hydrotreating reaction zone operating with a continuous liquid-phase with hydrotreating catalyst at conditions effective to produce ultra-low sulfur diesel.

17. The process of claim 16, wherein make-up hydrogen is fed to the first hydrotreating reaction zone without recycle from a hydroprocessing reaction zone.

18. The process of claim 17, further comprising fractionating a second hydrotreated effluent from the second hydrotreating reaction zone in the fractionation zone to provide ultra-low sulfur diesel.

19. The process of claim 18, wherein the fractionation zone includes a dividing wall column and said first hydrotreated effluent is fed to a first side of a dividing wall in said dividing wall column and said second hydrotreated effluent is fed to a second side of said dividing wall and further comprising recovering said feed diesel stream from said first side of said dividing wall and recovering ultra-low sulfur diesel from said second side of said dividing wall.

* * * * *